US010781730B2

(12) United States Patent
Lenk et al.

(10) Patent No.: US 10,781,730 B2
(45) Date of Patent: Sep. 22, 2020

(54) METHOD AND DEVICE FOR ACQUIRING THE OIL TEMPERATURE IN AN INTERNAL COMBUSTION ENGINE

(71) Applicant: CPT Group GmbH, Hannover (DE)

(72) Inventors: Jan-Richard Lenk, Regensburg (DE); Sebastian Viehöver, Regensburg (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/348,598

(22) PCT Filed: Oct. 25, 2017

(86) PCT No.: PCT/EP2017/077349

§ 371 (c)(1),
(2) Date: May 9, 2019

(87) PCT Pub. No.: WO2018/086891

PCT Pub. Date: May 17, 2018

(65) Prior Publication Data

US 2020/0063667 A1 Feb. 27, 2020

(30) Foreign Application Priority Data

Nov. 10, 2016 (DE) ..... 10 2016 222 044

(51) Int. Cl.
*F01M 11/10* (2006.01)
*F02D 35/02* (2006.01)
(Continued)

(52) U.S. Cl.
CPC ..... *F01M 5/005* (2013.01); *F01M 11/10* (2013.01); *F02D 35/02* (2013.01);
(Continued)

(58) Field of Classification Search
CPC ..... F02D 41/1454; F02D 41/26; F02D 2200/023; F02D 2200/0406;
(Continued)

(56) References Cited

U.S. PATENT DOCUMENTS 2,695,877 A 11/1954 Nichols, Jr. et al. ..... 508/311
4,847,768 A * 7/1989 Schwartz ..... B60Q 9/00 701/29.5

(Continued)

FOREIGN PATENT DOCUMENTS

DE 199 61 118 A1 7/2001 ..... F02D 41/00
DE 101 294 21 A1 1/2002 ..... F01M 5/00

(Continued)

OTHER PUBLICATIONS

Teja, "Simple Method for the Calculation of Heat Capacities of Liquid Mixtures", Journal of Chemical Engineering Data, vol. 28, Issue 1, pp. 83-85, Jan. 1, 1983.

(Continued)

*Primary Examiner* — Mahmoud Gimie
(74) *Attorney, Agent, or Firm* — Slayden Grubert Beard PLLC

(57) ABSTRACT

Various embodiments include a method for determining the temperature of an engine oil in an internal combustion engine comprising: acquiring a value of a parameter characterizing a current operating point of the internal combustion engine; and calculating the temperature of the engine oil using an oil temperature model. The oil temperature model depends at least in part on dilution of the engine oil caused by different components in the engine oil and accounts for modified heating behavior of the engine oil based on the dilution.

6 Claims, 3 Drawing Sheets

(51) Int. Cl.
*F02D 41/14* (2006.01)
*F01M 5/00* (2006.01)
*F02D 41/26* (2006.01)

(52) U.S. Cl.
CPC ..... *F02D 41/1454* (2013.01); *F02D 41/26* (2013.01); *F01M 2011/1473* (2013.01); *F02D 2200/023* (2013.01); *F02D 2200/0406* (2013.01); *F02D 2250/11* (2013.01)

(58) Field of Classification Search
CPC .... F02D 2250/11; F01M 11/10; F01M 5/005; F02M 2011/1473
USPC ..... 701/102
See application file for complete search history.

(56) References Cited

U.S. PATENT DOCUMENTS

| | | | | |
|---|---|---|---|---|
| 6,393,357 | B1 | 5/2002 | Holmes et al. | 701/115 |
| 7,069,141 | B2 * | 6/2006 | Kunz | F01M 1/18 701/102 |
| 2002/0161508 | A1 | 10/2002 | Pfeiffer et al. | 701/113 |
| 2004/0128059 | A1 | 7/2004 | Kunz et al. | 701/114 |
| 2009/0119056 | A1 | 5/2009 | Lehner et al. | 702/136 |
| 2012/0310514 | A1 | 12/2012 | Viehover et al. | 701/112 |
| 2013/0345925 | A1 | 12/2013 | Smolenski et al. | 701/31.9 |
| 2015/0292418 | A1 | 10/2015 | Haft et al. | 701/103 |
| 2018/0003092 | A1 * | 1/2018 | MacFarlane | F01M 1/16 |

FOREIGN PATENT DOCUMENTS

| | | | | |
|---|---|---|---|---|
| DE | 100 06 533 | B4 | 11/2005 | F01M 11/10 |
| DE | 10 2008 054 064 | A1 | 6/2009 | F01M 11/10 |
| DE | 10 2010 006 580 | B3 | 7/2011 | F02D 41/00 |
| DE | 10 2011 088 858 | A1 | 6/2013 | F02D 41/00 |
| DE | 10 2011 121 415 | A1 | 6/2013 | G01N 33/26 |
| DE | 10 2012 221 507 | B3 | 11/2013 | F02D 19/08 |
| DE | 10 2013 211 308 | A1 | 12/2013 | F01M 11/10 |
| EP | 1363123 | A2 * | 11/2003 | F01M 11/10 |
| EP | 1 586 752 | B1 | 7/2008 | F01M 5/00 |
| EP | 1 452 701 | B1 | 2/2009 | F01M 11/10 |
| EP | 1 900 911 | B1 | 6/2012 | F01M 11/10 |
| EP | 2535708 | A1 * | 12/2012 | G01N 11/00 |
| WO | 02/086296 | A2 | 10/2002 | F01M 1/18 |
| WO | WO-2009068770 | A1 * | 6/2009 | F02D 41/047 |
| WO | 2018/086891 | A1 | 5/2018 | F01M 11/10 |

OTHER PUBLICATIONS

German Office Action, Application No. 10 2016 222 044.6, 5 pages, dated Oct. 18, 2017.
International Search Report and Written Opinion, Application No. PCT/EP2017/077349, 20 pages, dated Jan. 18, 2018.

* cited by examiner

METHOD AND DEVICE FOR ACQUIRING THE OIL TEMPERATURE IN AN INTERNAL COMBUSTION ENGINE

During the operation of the internal combustion engine, in particular spark-ignition engines with fuel injection or Flex-fuel motors which can be operated with any desired fuel composition of gasoline and ethanol, to certain extent considerable amounts of fuel as well as of inert gas pass, as so-called blow-by, into the crank casing via the cylinder walls and the piston rings. This accumulated fuel has a negative effect on the lubrication effect, viscosity and lifetime of the engine oil. Particularly in the cold operating state, to certain extent the cylinder inner walls are wetted excessively with fuel, which then passes into the crank casing via the piston rings and ultimately is accumulated as fuel in the engine oil.

If the internal combustion engine is not heated up to the optimum operating temperature, the accumulated fuel mass becomes larger after each time the internal combustion engine is started. When the internal combustion engine is heated to the operating temperature, the accumulated fuel begins to boil and becomes gaseous. This accumulated fuel brings about relatively slow heating of the engine compared with the heating behavior without dilution of the oil. As result, the oil temperature which is modeled by means of the known oil temperature models does not correspond to the real profile.

SUMMARY

The teachings of the present disclosure describe methods and devices which permit the temperature of the engine oil of an internal combustion engine to be determined with a high level of accuracy while dispensing with an oil temperature sensor. For example, some embodiments include a method for determining the temperature (T_OIL) of an engine oil (16) in an internal combustion engine (10), in which the temperature (T_OIL) of the engine oil (16) is acquired using an oil temperature model (OIL_TM), and at least one parameter which characterizes the operating point of the internal combustion engine (10) is included in the calculation as an input variable of the oil temperature model (OIL_TM), characterized in that during the modeling of the temperature (T_OIL) of the engine oil (16), dilution of the engine oil (16), caused by different components in the engine oil (16), is included by taking into account the modified heating behavior of the engine oil (16).

In some embodiments, the components which are input into the engine oil (16) are determined by means of an oil-dilution model (OIL_VM).

In some embodiments, the input masses are determined for the individual components which are input, and a boiling characteristic curve (58) is assigned for each input mass and is stored in a value memory (43) of a control device (40) which performs open-loop and/or closed-loop control of the internal combustion engine (10).

In some embodiments, a correction factor, with which the modeled oil temperature (T_OIL) is corrected in the direction of low values, is acquired using the boiling characteristic curves (58). In some embodiments, at least one of the variables of the coolant temperature (TCO), air mass flow (MAF), intake manifold pressure, air/fuel ratio (λ) is used as a parameter characterizing the operating point of the internal combustion engine (10).

As another example, some embodiments include a control device for an internal combustion engine (10) of a motor vehicle, wherein the control device is configured in such a way that the method as described above can be executed.

BRIEF DESCRIPTION OF THE DRAWINGS

An exemplary embodiment of the teachings herein is described below in more detail with reference to the appended figures. Of the said figures.

DETAILED DESCRIPTION

The present disclosure describes methods and systems wherein the influence of the heating behavior of the engine oil is taken into account during the modeling of the engine oil temperature, by the different components accumulated in the engine oil. By including the various heat conductivity values and vapor pressures of the foreign bodies accumulated in the engine oil, such as ethanol or water, which, as the mass proportion rises, significantly influence the coefficient of thermal conduction of the engine oil mixture and therefore the heating behavior, the accuracy of the oil temperature model can be increased, particularly during the warming up of the internal combustion engine. Furthermore, more precise pilot control of the injection mass to be corrected can therefore be achieved by the hydrocarbons boiling out of the engine oil, and more precise determination of the lost torque and more selective enabling of OBD diagnoses and adaptations can be achieved.

The function can be used both for spark-ignition engines and for diesel engines. In some embodiments, the components which are accumulated in the engine oil are determined by means of an oil dilution model, and the accumulation masses are determined for the individual accumulated components, and a boiling characteristic curve is assigned for each accumulation mass and is stored in a value memory of a control device which performs open-loop and closed-loop control of the internal combustion engine. The boiling curves are directly dependent on the maximum accumulated mass, of the respectively defined component. Therefore, the boiling curve is approximated to the falsified oil temperature, and the effect described at the beginning is corrected.

Figure 1:
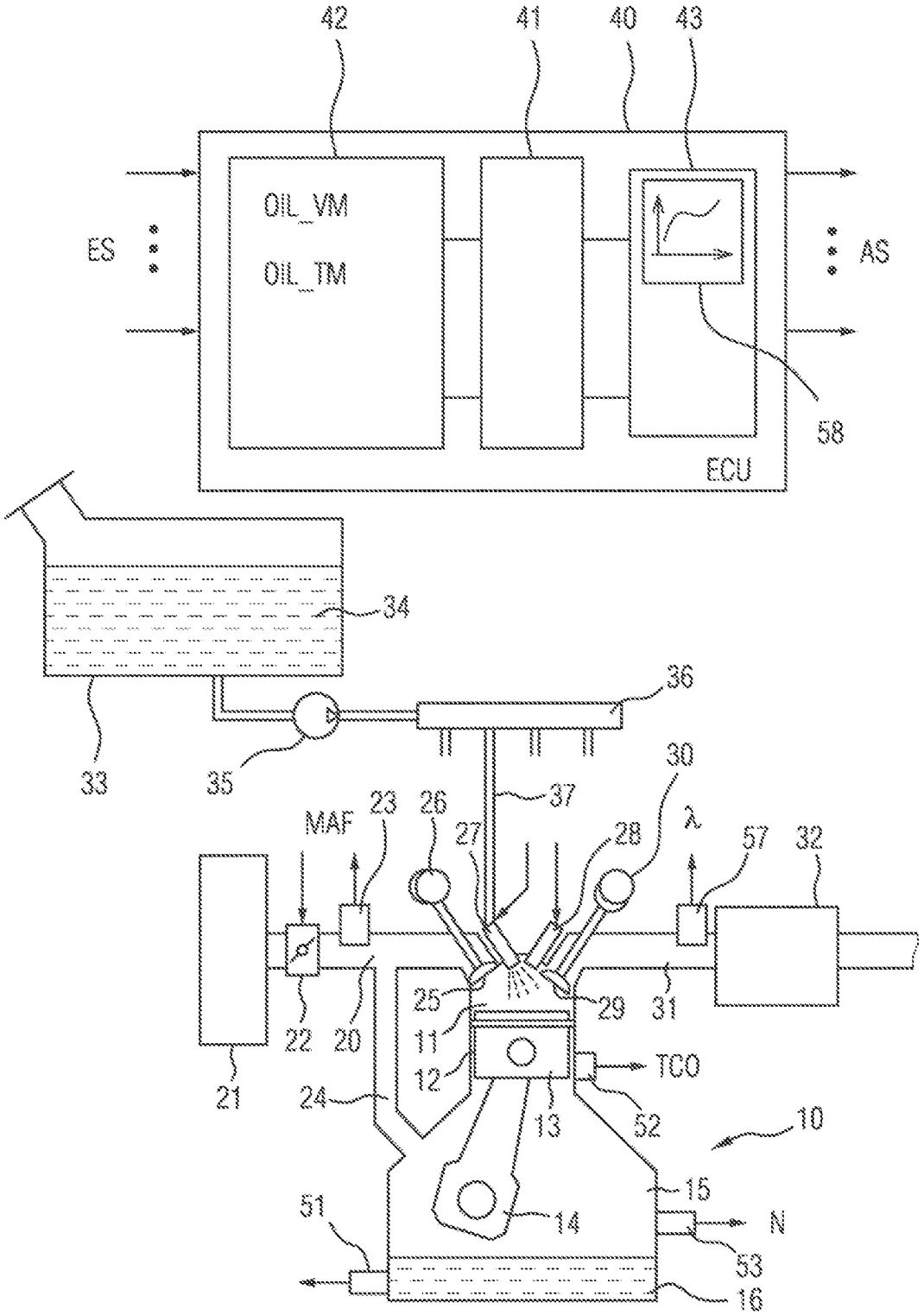
FIG. 1 shows a schematic illustration of an internal combustion engine with an assigned control device incorporating teachings of the present disclosure.

FIG. 1 shows a schematic illustration of an internal combustion engine 10 with a combustion chamber 11 in a cylinder 12. The combustion chamber 11 is closed off on one side (on an underside in FIG. 1) by a piston 13. The piston 13 is connected via a connecting rod 14 to a crankshaft (not illustrated in FIG. 1) in a crank casing 15. Moving parts of the internal combustion engine 10, in particular the piston 13 which moves to and fro in the cylinder 12, are lubricated by lubricant 16, referred to below as engine oil. The engine oil collects in the crank casing 15 and is circulated and filtered by devices (not illustrated in FIG. 1).

The internal combustion engine 10 also has an intake tract 20, in which, in succession in the direction of flow of the sucked-in air, an air filter 21, a throttle valve 22 and an air mass flow sensor 23 which serves as a load sensor are arranged. In some embodiments, an intake pressure manifold sensor can be provided as a load sensor in the intake tract 20. Furthermore, a venting line 24 of the crank casing 15 opens into the intake tract 20 downstream of the throttle valve 22. A shut-off valve, in particular an electric shut-off valve (not official), can be provided in the venting line 24.

The intake tract 20 is connected to the combustion chamber 11 via a gas inlet valve 25. The gas inlet valve 25 is controlled by means of a camshaft 26. In addition, a fuel injection valve 27 for directly injecting the fuel into the combustion chamber 11 and a spark plug 28 are arranged at the head of the cylinder 12 of the internal combustion engine 10. The fuel injection valve 27 can alternatively be arranged on the intake tract 20 and therefore upstream of the inlet valve 25 in the direction of flow. In this case, the term intake manifold injection or duct injection is used.

The combustion chamber 11 of the internal combustion engine 10 is also connected to an exhaust tract 31 via a gas outlet valve 29, which is controlled by means of a camshaft 30. One or more exhaust gas catalytic converters 32 and/or other devices for filtering or preparing exhaust gases of the internal combustion engine 10 can be arranged in the exhaust gas tract 31.

In order to supply fuel to the internal combustion engine 10, a fuel tank 33 is provided in which fuel 34 is stored. In this context, gasoline, alcohol or any desired mixture of the two can be used as the fuel 34. The fuel 34 is pumped by means of a high-pressure fuel pump 35 from the fuel tank 33 to a distributor pipe (common rail) from which in each case a feed line 37 leads to each fuel injection valve 27. Further components, present in the fuel path, such as a low pressure pump (intake pump), pressure regulator, pressure sensor, valves and return lines are omitted for reasons of clarity.

In order to perform open-loop and/or closed-loop control of the internal combustion engine 10, an electronic control device (ECU, electronic control unit) 40 is provided. The control device 40 contains a computational unit (processor) 41, which is coupled to a program memory 42 and a value memory (data memory) 43. The processor 40, the program memory 42 and the value memory 43 can each comprise one or more microelectronic components. As an alternative, these components can be partially or completely integrated into a single microelectronic component. The program memory 42 and/or the value memory 43 store/stores programs or values which are necessary for the operation of the internal combustion engine 10. In particular, what is referred to as an oil dilution model OIL_VM, with which the fuel which is input into the engine oil 16 and the fuel which is extracted from the engine oil 16 are determined, is implemented in the program memory 42. Such oil dilution models are described, for example, in the applicant's documents DE 10 2010 006 580 and B3 DE 10 2012 221 507 B3, the content of which is incorporated herewith in this regard. Furthermore, a method OIL_TM for the model-assisted acquisition of the temperature of the engine oil 16 is implemented in the program memory 42 and executed by the computational unit 41 during the operation of the internal combustion engine 10. Suitable oil temperature models are described, for example, in the applicant's documents WO 02/086296, DE 10 06 533 B4 and DE 10 2011 088 858 A1, the content of which is incorporated herewith in this regard. Inter alia, boiling characteristic curves 58 for various fuel components are stored in the value memory 43, the significance of which components is also explained in more detail below with reference to the following description.

The control device 40 is assigned a plurality of sensors which acquire various measurement variables and each determine the measured value of the measurement variable. Operational variables comprise not only the measurement variables but also variables derived therefrom. The control device 40 determines, as a function of at least one of the measurement variables and/or the operating variables, manipulated variables which are then converted into one or more actuation signals for controlling the actuators by means of corresponding actuator drives.

The sensors are, for example, the air mass flow meter 23, which outputs a signal MAF for the air mass flow in the intake tract 20, a filling level sensor 51 for the engine oil 16 in the crank casing 15, a temperature sensor 52 for the cooling medium of the internal combustion engine 10, which outputs a signal TCO, a crankshaft angle sensor 53 which acquires a crankshaft angle to which a rotational speed N is then assigned, a lambda probe 57 upstream of the exhaust gas catalytic converter 32 whose signal λ is characteristic of the air/fuel ratio in the combustion chamber 11 of the cylinder 12. Signals from further sensors which are necessary for the operation of the internal combustion engine 10 but are not explicitly illustrated are generally identified by the reference symbol ES.

The actuator elements are, for example, the throttle valve 22 in the intake tract 20 and the fuel injection valve 27. Further signals for further actuator elements which are necessary for the operation of the internal combustion engine 10, but not explicitly illustrated, are generally identified by the reference symbol AS. In addition to the cylinder 12, further cylinders can also be provided and corresponding actuators are also assigned to them. The application of the method according to the invention is independent of the number of the cylinders of the internal combustion engine.

The control device 40 determines the suitable ignition time, the injection time and the rotational speed, inter alia as a function of a load signal and the rotational speed and taking into account the signals of the specified further sensors. If a crank casing venting process takes place, the fuel components which evaporate out of the engine oil are also taken into account in this calculation. The fuel accumulated in the engine oil brings about relatively slow heating of the engine oil compared with the heating behavior of "pure engine oil". In this context, the term pure engine oil is to be understood as meaning an engine oil which, in contrast to contaminated engine oil, is free of an input of fuel, in particular an input of ethanol, and free of further input components such as, for example, water.

The heating of the engine oil 16 is influenced by four essential factors:

a) by the operating point of the internal combustion engine 10 and the input of thermal energy connected thereto, by the combustion process of the fuel/air mixture in the cylinder 12, b) by the friction energy of the components and fluids moving in the internal combustion engine 10 c) by the ambient temperature (current temperature gradient) or speed and temperature of the medium which flows around the internal combustion engine 10, and d) by the composition of the engine oil 16.

The required quality of heat ΔQ [J] for increasing the temperature of a medium by Δϑ is calculated as follows $$\Delta Q = \Delta\vartheta * c_p * m$$

wherein $$c_p\left[\frac{\mathrm{J}}{\mathrm{kg\ K}}\right]$$

represents the specific isobaric thermal capacity and m is the mass of the medium to be heated.

The thermal quantity ΔQ is directly dependent on the mass m. As the mass m increases, more energy must therefore also be fed in in order to reach the same temperature rise Δϑ. The thermal quantity of a mixture of, for example, engine oil and ethanol (as the fuel which is input into the engine) results from the mixture ratio thereof as well as the specific thermal capacities of the individual materials:

$$\Delta Q=\Delta\vartheta_{\ddot{o}l}*c_{p\text{-}\ddot{o}l}*m_{\ddot{o}l}+\Delta\vartheta_{ethanol}*c_{p\text{-}ethanol}*m_{ethanol}$$

Customary engine oils for internal combustion engines have, depending on the viscosity class a density of 840-880 kg/m$^3$.

In order to heat three liters of engine oil with a density of 868 kg/m$^3$ by 1 kelvin, the following is required:

$$\ddot{O}l\text{: } Q_{p\text{-}\ddot{o}l} = 0.003\ \mathrm{m}^3 * 868\frac{\mathrm{kg}}{\mathrm{m}^3} * 2010\frac{\mathrm{J}}{\mathrm{kg\ K}} * 1\ \mathrm{K} = 5.2\ \mathrm{kJ}$$

In order to heat 1 liter of ethanol by 1 kelvin, the following is required:

Ethanol:

$$Q_{p\text{-}ethanol} = 0.001\ \mathrm{m}^3 * 806\frac{\mathrm{kg}}{\mathrm{m}^3} * 1730\frac{\mathrm{J}}{\mathrm{kg\ K}} * 1\ \mathrm{K} = 1.4\ \mathrm{kJ}$$

If oil dilution of one liter of ethanol occurs in a spark-ignition internal combustion engine, an additional expenditure of energy of 1.4 kJ must be generated in order to heat the engine oil/ethanol mixture by 1 kelvin. A precondition is an isobaric operating point and for the conducted-away heat to be discounted. If the mixture has heated up to the boiling point of the first component, it follows the ideal boiling diagram.

Figure 2:
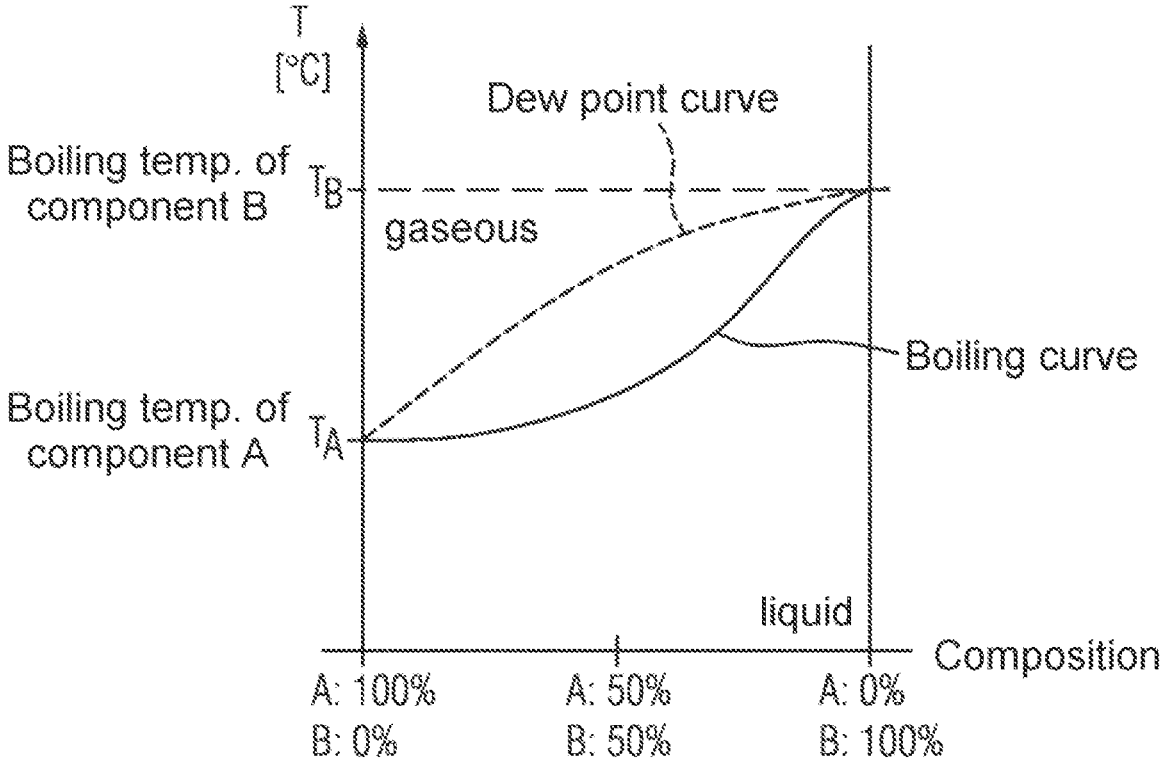
FIG. 2 shows a boiling diagram for two fuel components.

Such a boiling diagram for two components A and B is illustrated in FIG. 2. The component A is a material with lower boiling point than component B. The pressure is to be assumed as a constant (isobar) for this example. Furthermore, just one example with 2 different components is also considered here; in reality there are far more components which are present in the engine oil. If an ideal mixture of the components A and B is heated, the temperature rises in a regular fashion until the boiling point of the component A is reached. From there the temperature rise follows a boiling curve which is composed of the different boiling points, or in other words, the various vapour pressures at the same temperature, of the integral components. Expressed in simplified terms, the smaller the proportion of the mixture which is made up by the mass component of component A, the higher the boiling temperature of the mixture. When the boiling temperature of material B is reached, component A has completely evaporated and is no longer present in a liquid form.

Transferred to the present situation, this results in the engine oil in an internal combustion engine heating correspondingly more slowly under constant conditions (same supplied heat) if oil dilution occurs, for example by ethanol (boiling point is ~78° C. at ~1 bar).

To summarise, two effects are therefore basically responsible for the fact that a slowed-down heating behavior of the engine oil occurs. Mainly the increase in mass, but also the changed temperature behavior during the evaporation process plays a role. Correspondingly, a temperature model which determines the temperature of the engine oil must be corrected as long as it contains a minimum amount of foreign substances to be defined (substances which usually cannot be found in the oil after an oil change). The influence of the oil dilution on the heating behavior of the engine oil can be measured.

Figure 3:
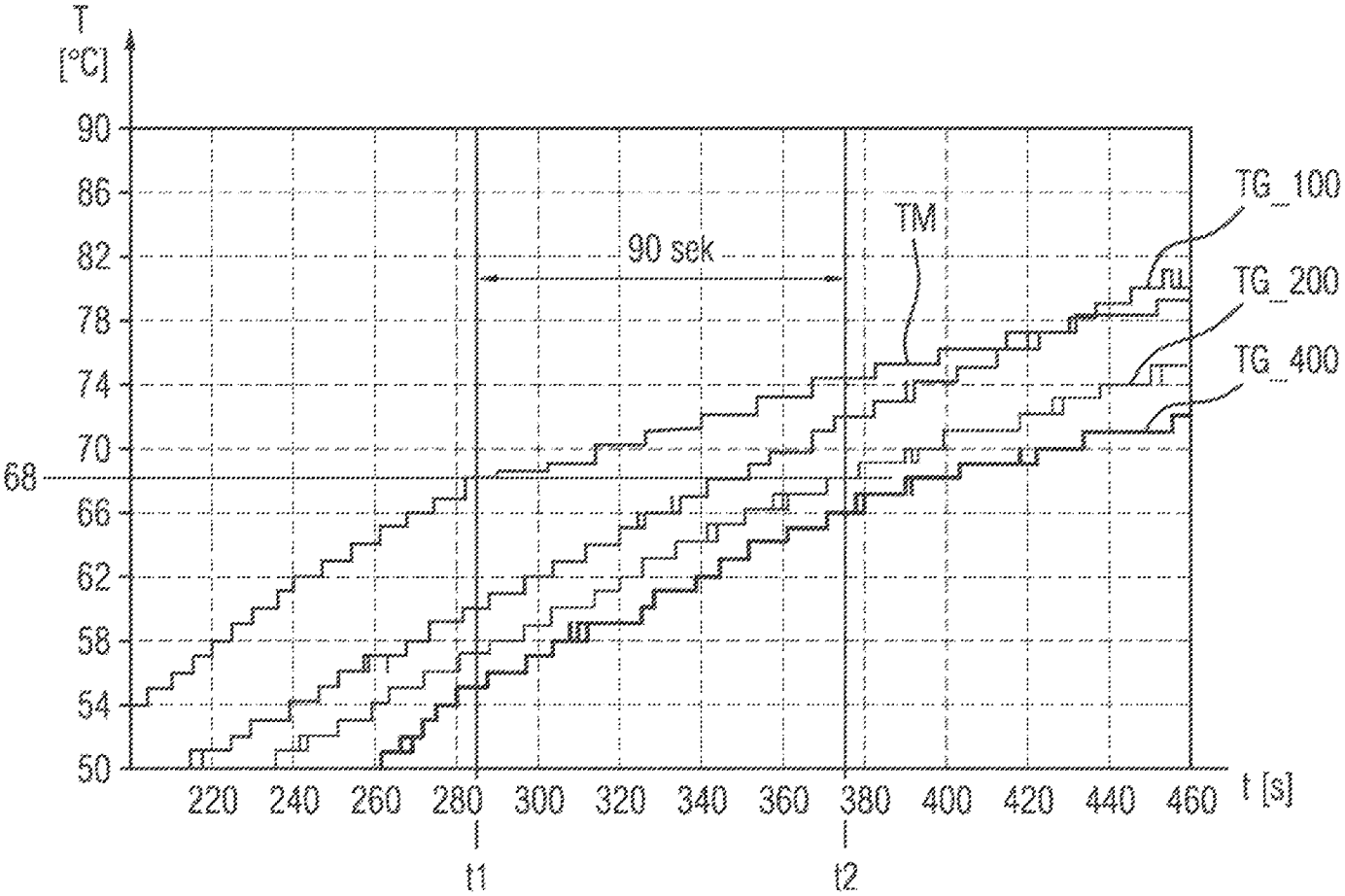
FIG. 3 shows a diagram clarifying the heating behavior of the engine oil with various degrees of oil dilution.

The heating behavior of an engine oil with different levels of oil dilution is shown in FIG. 3 in the form of a diagram. In this context, the time t is plotted in increments of 20 seconds on the abscissa and the temperature of the engine oil T_OIL is plotted on the ordinate. In this context, three trials were carried out during which a specific mass of ethanol was manually fed to the engine oil. The temperature of the engine oil which was artificially diluted, and therefore contaminated, in this way was measured during the heating of the vehicle equipped with the internal combustion engine at the same location at a constant operating point which was the same over all three trials. The characteristic curve TG_100 characterizes here the chronological temperature profile of the engine oil with 100 g of added ethanol, the characteristic curve TG_200 characterizes the chronological temperature profile of the engine oil with 200 g of added ethanol, and the characteristic curve TG_400 characterizes the chronological temperature profile of the engine oil with 400 g of added ethanol.

The characteristic curve TM shows the profile of the engine oil temperature T_OIL such as is calculated by an oil temperature model, known from the prior art, for pure engine oil, that is to say without taking into account the oil dilution. It is possible to clearly see the differences in the measured oil temperature of the engine oil diluted with ethanol in comparison with the known oil temperature model without taking into account the ethanol dilation. The oil temperature model generally supplies an excessively high temperature value owing to the oil dilution which is not taken into account.

In the following table, the measured and modeled temperature values for the ethanol masses given above are plotted for two different times t1 and t2.

| Ethanol mass | Measured oil temperature, time [° C.] | | Modeled oil temperature, time [° C.] | |
|---|---|---|---|---|
| [g] | t1: | t2: | t1: | t2: |
| 100 | 60 | 72 | 68 | 75 |
| 200 | 57 | 68 | 67 | 74 |
| 400 | 55 | 66 | 67 | 74 |

From this table it is apparent, on the one hand, that at the time t1, that is to say relatively shortly after the start of the heating process, the differences between the measured and modeled temperatures are higher than at a later time t2 when heating has progressed. On the other hand, it is apparent that with larger ethanol contents in the engine oil the differences between the measured and model temperatures also increase. When there are even larger ethanol masses in the engine oil, this effect is even much more pronounced.

The difference between the measured and model temperatures becomes even clearer if the difference in timing is considered. The engine oil with fuel dilution of 200 g of ethanol (curve TG 200) only reaches a temperature of 68° C. 90 sec after the modeled oil temperature reaches this value. The modeled oil temperature is taken here as a reference for "clean" engine oil. That is to say engine oil which is contaminated with 200 g of ethanol reaches a temperature of 68° C. 90 seconds later at this constant operating point. This chronological offset brings about, inter alia, a fault in the outgassing model of the ethanol within the oil dilution model, according to which the oil temperature model is oriented.

LIST OF TERMS/REFERENCE SYMBOLS

10 Internal combustion engine
11 Combustion chamber
12 Cylinder
13 Piston
14 Connecting rod
15 Crank casing
16 Lubricant, engine oil
20 Intake tract
21 Air filter
22 Throttle valve
23 Air mass flow meter, load sensor
24 Venting line
25 Gas inlet valve
26 Camshaft
27 Fuel injection valve
28 Spark plug
29 Gas outlet valve
30 Camshaft
31 Exhaust gas tract
32 Exhaust gas catalytic converter
33 Fuel tank
34 Fuel
35 High-pressure fuel pump
36 Distributor pipe
37 Feed line
40 Control device
41 Computational unit, processor
42 Program memory
43 Value memory, data memory
51 Filling level sensor for engine oil
52 Temperature sensor for coolant
53 Crankshaft angle sensor
57 Lambda probe upstream of exhaust gas catalytic converter
58 Boiling characteristic curve
A Component
B Component
AS Signals for actuator elements
ES Signals of sensors
λ Air/fuel ratio
MAF Air mass flow
N Speed
OIL_VM Oil dilution model
OIL_TM Oil temperature model
$T_A$ Boiling temperature of component A
TCO Coolant temperature
$T_B$ Boiling temperature of component B
TCO Coolant temperature
TG_100 Temperature profile of engine oil with 100 g of added ethanol
TG_200 Temperature profile of engine oil with 200 g of added ethanol
TG_400 Temperature profile of engine oil with 400 g of added ethanol
TM Temperature profile of non-diluted engine oil
t Time
t1, t2 Time

What is claimed is:

1. A method for determining the temperature of an engine oil in an internal combustion engine, the method comprising:

acquiring a value of a parameter characterizing a current operating point of the internal combustion engine;

calculating the temperature of the engine oil using an oil temperature model, including:

identifying multiple different components in the engine oil;

determining a respective input mass for each component in the engine oil;

accessing a respective boiling characteristic curve corresponding to each component in the engine oil; and calculating the temperature of the engine oil based at least in part on the respective input masses and corresponding boiling characteristic curves for the different components in the engine oil, such that the oil temperature model depends at least in part on dilution of the engine oil caused by different components in the engine oil and accounts for modified heating behavior of the engine oil based on the dilution.

2. The method of claim 1, comprising determining the different components in the engine oil using an oil-dilution model.

3. The method of claim 1, further comprising:

controlling an operation of the internal combustion engine based on the calculated temperature of the engine oil.

4. The method of claim 1, further comprising determining an oil temperature correction factor based on the boiling characteristic curves for the different components in the engine oil.

5. The method of claim 1, further comprising including at least one variable selected from the group consisting of: coolant temperature, air mass flow, intake manifold pressure, and air/fuel ratio as a parameter characterizing a current operating point of the internal combustion engine.

6. A control device for an internal combustion engine of a motor vehicle, the control device comprising:

a processor; and a memory storing a set of instructions, the instructions, when accessed and executed by the processor, causing the processor to:

acquire a value of a parameter characterizing a current operating point of the internal combustion engine;

calculate the temperature of the engine oil using an oil temperature model by:

identifying multiple different components in the engine oil;

determining a respective input mass for each component in the engine oil;

accessing a respective boiling characteristic curve corresponding to each component in the engine oil; and calculating the temperature of the engine oil based at least in part on the input masses and corresponding boiling characteristic curves for the different components in the engine oil; and control an operation of the internal combustion engine based on the calculated temperature of the engine oil.

* * * * *